US005836795A

United States Patent [19]

Kaul et al.

[11] Patent Number: 5,836,795

[45] Date of Patent: Nov. 17, 1998

[54] WATERCRAFT DRIVE WITH A RUDDER PROPELLER

[76] Inventors: Stefan Kaul, Mühlenweg 12, DE-56307 Harschbach; Reinhold Reuter, Gartenstrasse 6, DE-56281 Schwall, both of Germany

[21] Appl. No.: 817,472

[22] PCT Filed: Nov. 14, 1995

[86] PCT No.: PCT/EP95/04481

§ 371 Date: Apr. 14, 1997

§ 102(e) Date: Apr. 14, 1997

[87] PCT Pub. No.: WO96/15028

PCT Pub. Date: May 23, 1996

[30] Foreign Application Priority Data

Nov. 15, 1994 [DE] Germany ..... 44 40 738.6

[51] Int. Cl.[6] ..... B63H 1/18

[52] U.S. Cl. ..... 440/66; 440/67; 114/151

[58] Field of Search ..... 114/151; 440/67, 440/81, 66; 415/66, 68

[56] References Cited

U.S. PATENT DOCUMENTS

| | | | |
|---|---|---|---|
| 3,127,865 | 4/1964 | Pleuger | 114/151 |
| 4,074,652 | 2/1978 | Jackson | 114/151 |

FOREIGN PATENT DOCUMENTS

| | | |
|---|---|---|
| 293 611 | 5/1914 | Germany . |
| 870 655 | 7/1949 | Germany . |
| 35 08 203 A1 | 9/1986 | Germany . |
| 2 190 344 | 11/1987 | United Kingdom . |

*Primary Examiner*—Sherman Basinger
*Attorney, Agent, or Firm*—Levine & Mandelbaum

[57] ABSTRACT

A watercraft drive has a double rudder propeller driven by a driving engine via a driving shaft (1), an angular gear (3, 4) and an output transmission shaft (5). A propeller (6, 7) is arranged at each end of the output shaft. A guiding device made of guide blades (8*a*, 8*b*) is arranged between the propellers to correct aerodynamic conditions between both propellers (6, 7) and thus to reduce energy losses.

4 Claims, 2 Drawing Sheets

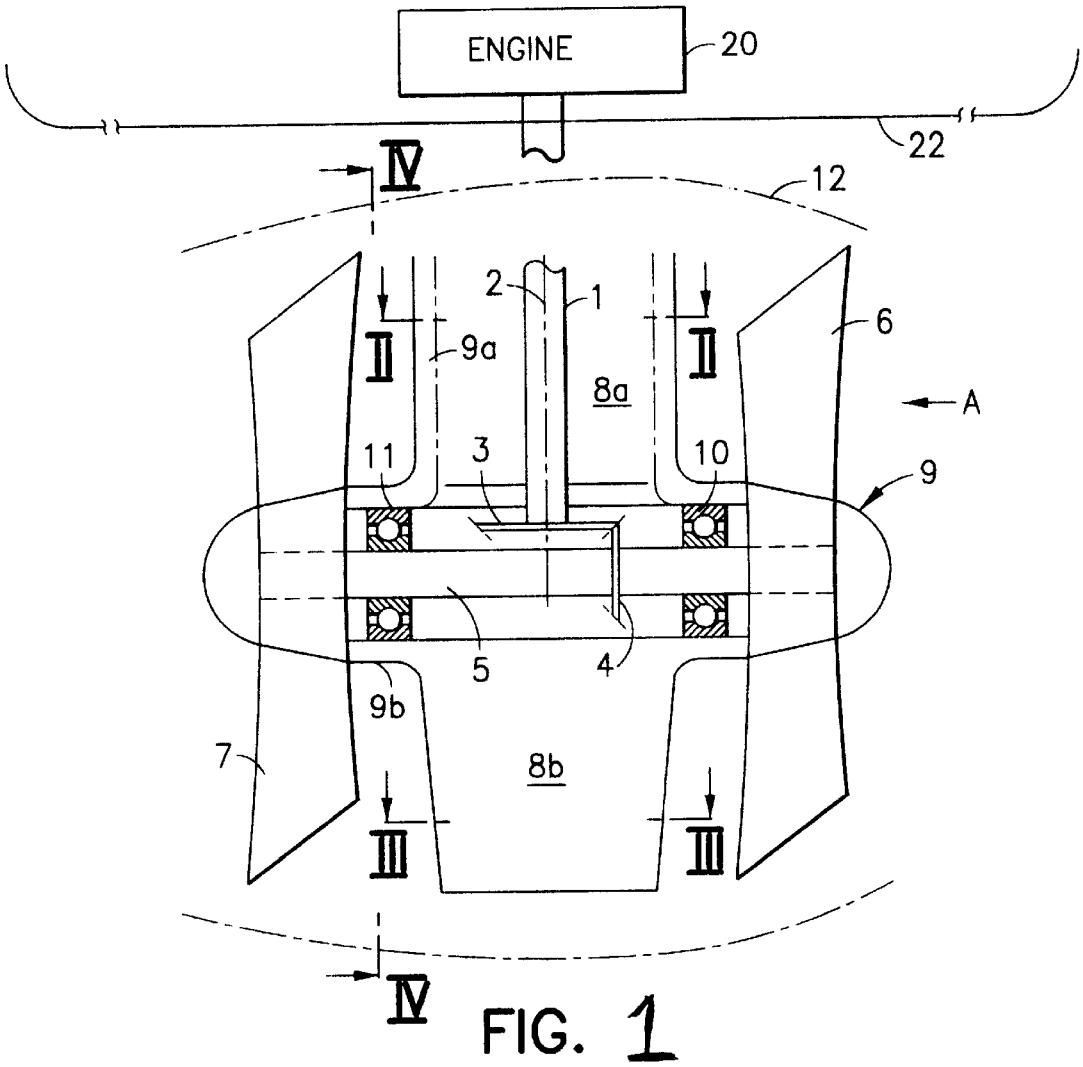
FIG. 1
FIG.2
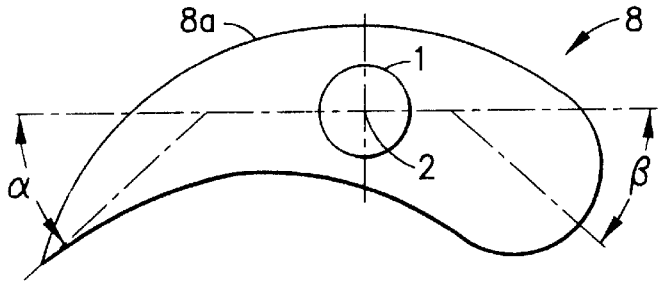
FIG.3
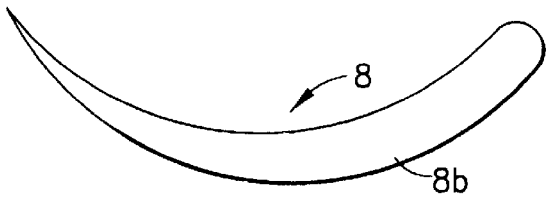

WATERCRAFT DRIVE WITH A RUDDER PROPELLER

BACKGROUND OF THE INVENTION

The present invention pertains to a watercraft drive with a driving engine and a double rudder propeller, which is driven by the driving engine through driving shafts, angular gear and output transmission shafts, and the propellers are connected to the output shafts in a manner adapted to rotate in unison.

In another previously known propeller arrangement for the drive of a watercraft, two horizontal propeller shafts are arranged at the lower end of a vertical driving shaft or two vertical driving shafts, which are surrounded by a housing tube, with insertion of an angular gear drive, and each one of two propellers is arranged to rotate in unison at the ends of the propeller shafts, which face away from the angular gear drive. The angular gear drive is designed such that an angular gear of the angular gear drive is arranged between a lower shaft end or the lower vertical shaft ends of the vertical shafts or the lower vertical shafts and each of the horizontal shafts. The two propeller shafts, which are output transmission shafts at the same time, are arranged on one side of this drive housing, or one of the propeller shafts is arranged on each side of the drive housing and is led out of the drive housing correspondingly. If both propeller shafts and thus both propellers are arranged on one side of the drive housing, then one of these shafts surrounds the other concentrically like a hollow shaft. The two propellers have different designs, especially in the respect that the direction of rotation and the diameter of the propellers, but also probably the number of blades, are different at any rate (GB 2 190 344).

Finally, another state of the art (German Patent DE 35 08 203) deals with an embodiment of a guiding device for a watercraft drive, which is equipped with a propeller, to increase the thrust or to reduce the consumption of fuel and therefore affects the present invention, at the most, in features that practically embody the present invention A watercraft drive of this type is known from DE 870 655. The output of the driving engine, arranged inside the hull, is introduced into a vertically arranged driving shaft, the lower end of which is guided through the bottom of the watercraft towards the outside of the hull, drives horizontally arranged output shafts via an angular gear there, each of which has a propeller that is utilized for the propulsion of the watercraft at each end facing away from the angular gear. It is also possible to design such an arrangement as a rudder propeller, in that not only is the drive output introduced at the upper end of the vertically arranged shaft, but an actuator may also be activated, so that a jacket tube, which surrounds the drive shaft concentrically, is pivotable by up to 360° or all around the longitudinal axis of the driving shaft. If the actuator is activated, then the propellers are ultimately pivoted about the longitudinal axis of the driving shaft and not only is the output of the driving engine converted to thrust power, but it is possible to use the drive output for maneuvering the watercraft by means of pivoting the underwater part of the drive system by 360° as well. In the prior-art device, an angular gear and an output shaft are assigned to each propeller. Thus, both propellers can be driven independently of one another. However, the technical cost of this drive is not in proportion to the benefit that can be achieved from the separate operation of the two propellers.

SUMMARY OF THE INVENTION

The basic object of the present invention is to develop a watercraft drive of the type mentioned in the introduction, which has a simple design in terms of production technology, while contributing a high efficiency.

The object is accomplished with the features of claim 1 according to the present invention.

Here, both propellers are operated in a functionally identical manner with only one angular gear and one line of driving shafts. Thus, a drive, with which the structural volume is also markedly reduced, is created, which is considerably simpler and less susceptible compared with the state of the art.

With the guiding device, energy losses generated by cavitation, are, to a large extent, prevented, in that the guiding device adjusts the post-angular momentum that is produced by the front propeller and thus recovers lost energy.

A guiding device is known from DE 293 611; however, in this case, it is a propeller arrangement with a horizontal driving shaft, i.e., a propeller system without a rudder function.

The angular gear and the output shaft are, as a rule, surrounded by a housing that is simultaneously used to store the output shaft and the angular gear. According to one embodiment of the present invention, this housing forms an integral unit with the guiding device, while the housing tube surrounding the driving shaft is preferably designed as a guide blade. Thus, the area between the two propellers is used for an effective guiding device in an aerodynamically optimal manner.

The guiding device may, in a simple embodiment, be formed from two guide blades, which are arranged 180° about the axis of rotation of the propellers and extend radially from the axis of rotation of the propellers. Of course, it is also possible to provide more than two guide blades, which are arranged in a rotationally symmetrical manner about the axis of rotation of the propellers.

The guide blades preferably have curved lifting surface profiles, and it proves to be very aerodynamically favorable if the curvature is a pre-angular momentum curvature and a post-angular momentum curvature. The post-angular momentum of the front propeller can thus be adjusted effectively and the energy lost during the post-angular momentum due to the propulsion force produced during the circulation of the guide blades can be recovered again.

To utilize the action of the guide blades as much as possible, the lengthwise extension of the guide blades is, to a large extent, set to equal the radius of the peak circular movement of the propellers.

DESCRIPTION OF THE DRAWINGS

The present invention is described in detail based on the exemplary embodiments of the invention schematically shown in the drawing. In the drawing, FIG. 1 shows the longitudinal section of the lower end of a drive, FIG. 2 shows a section according to the line II—II in FIG. 1, FIG. 3 shows a section according to the line III—III in FIG. 1.

DESCRIPTION OF THE PREFERRED EMBODIMENT

Figure 4:
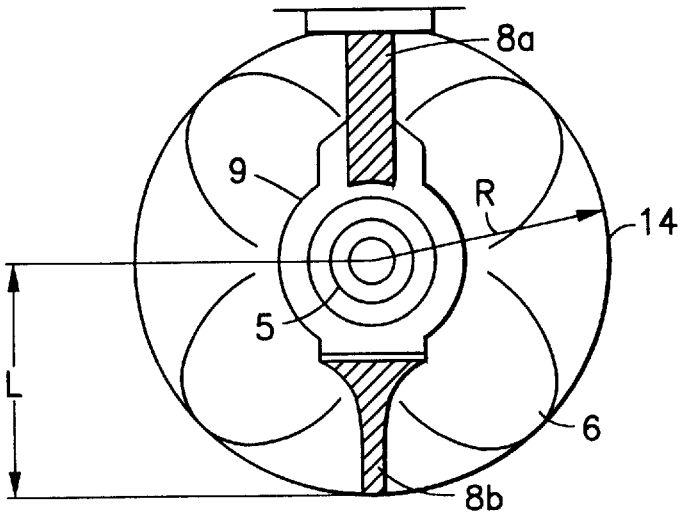
FIG. 4 shows a section according to the line IV—IV in FIG. 1.

FIG. 1 shows a watercraft drive that is designed as a double rudder propeller having a driving engine 20 arranged in the hull 22 with vertical driving shaft 1 and drive propellers outside of the hull 22.

The driving engine 20 which consists of a motor and gears acts on the upper end of the vertical driving shaft 1 in order to cause the driving shaft 1 to rotate about its longitudinal axis 2 at a variable speed. The input bevel gear 3 of an angular gear drive 3, 4, which actively communicates with the output bevel gear 4 of the angular gear 3, 4, is adapted to rotate in unison at the lower end of the driving shaft. The output bevel gear 4 has a horizontal output shaft 5 extending in both directions, which is adapted to rotate in unison, on each of the free ends of which a propeller 6, 7 is arranged to rotate in unison. The propellers will generally have different designs, although peak circular movements 14 having the same diameter, as well as similar blade geometries may be possible. Due to the common assignment to the output shaft 5, they have the same direction of rotation and the same speed, and flow, e.g., in the same direction according to the arrow A.

The angular gear 3, 4 is surrounded by a housing 9, in which the said output shaft 5 is rotatably mounted by means of two bearings 10, 11. This housing 9 is supported by a housing tube 9*a,* which surrounds the vertical drive axis 1 concentrically and can be pivoted about its longitudinal axis for the rudder function.

The underwater part of the drive system is able to be arranged within a nozzle 12.

The front propeller 6 produces a residual or post-angular momentum in its wake, which represents lost energy. The propeller 7, which is arranged downstream and rotates in the same direction, is impacted on by the wake of the front propeller. Without a guiding device between the two propellers 6, 7, the above-mentioned unfavorable wake would lead to increased cavitation and an increase in the energy losses.

To actively oppose this energy loss, a guiding device 8, with which the post-angular momentum of the front propeller 6 is adjusted, is provided between the two propellers 6, 7. Lost energy is recovered, in that a propulsion force is produced during the circulation of the guiding devices. In addition, a pre-angular momentum is produced for the propeller 7 arranged downstream, so that this propeller is able to reverse a higher energy drop. Taking this criterion into account, the second propeller 7 will preferably have a structural design that is different from the first propeller 6.

According to FIG. 1 the guiding device 8 comprises two guide blades 8*a* and 8*b,* whereby one guide blade 8*a* is formed by the housing tube 9*a* surrounding the vertical driving shaft 1. The second guide blade 8*b* is arranged on the underside 9*b* of the housing 9 surrounding the horizontal output shaft 5, i.e., offset by 180° from the first guide blade, and has a free edge distal from the housing 9. The two guide blades 8*a,* 8*b* form a structural unit with the entire housing 9, 9*a*.

FIGS. 2 and 3 each show a cross section of the upper guide blade 8*a* and the lower guide blade 8*b,* respectively. According to them, the guide blades 8*a,* 8*b* have curved lifting surface profiles, which have a pre-angular momentum curvature $\alpha$ to deflect the flow for the second propeller 7 and a post-angular momentum curvature $\beta$ to adjust the post-angular momentum of the first propeller 6.

The lengthwise extension L of the guide blades 8*a,* 8*b* corresponds, as is shown in FIG. 4, to the radius R of the peak circular movement 14 of the propellers 6, 7.

Figure 5:
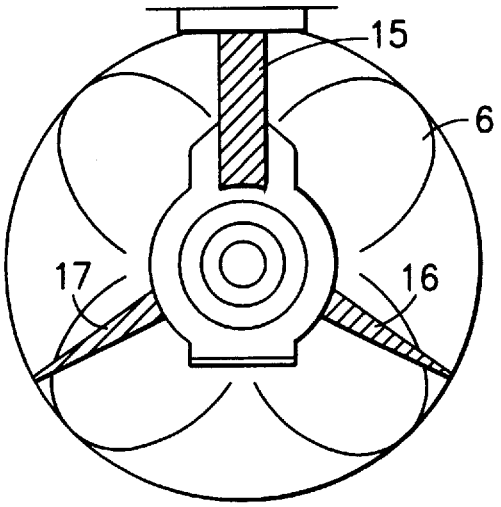
FIG. 5 shows another example of the guiding device.

FIG. 5 shows another example of a guiding device in a section that is identical to that in FIG. 4. In this example, three instead of two guide blades 15, 16, 17 are provided in rotationally symmetrical arrangement about the common axis of rotation 18 of both propellers 6, 7. Of course, the guiding device may also consist of more than three guide blades.

What is claimed is:

1. A drive for a watercraft for travel on a body of water, said watercraft having a hull and a driving engine, a drive shaft operatively connected to said driving engine, a housing having a vertical section surrounding said drive shaft and a horizontal section, an angular gear having input means operatively connected to said drive shaft and output means, an output shaft operatively connected to said angular gear output means, said horizontal section circumscribing said angular gear and a length of said output shaft connected thereto, a first propeller mounted on one end of said output shaft outside of said horizontal section and a second propeller mounted on the other end of said output shaft outside of said horizontal section for rotation in unison, and a guiding device mounted between and spaced from the propellers, for reducing cavitation and increasing the efficiency of said drive, said guiding device comprising a plurality of blades one of which is integral with said housing vertical section, and at least another of which has an edge connected to said housing horizontal section and an opposite free edge.

2. A drive in accordance with claim 1 wherein the guiding device comprises at least two guide blades in rotationally symmetrical arrangement about the common axis of rotation of said first and second propellers, each of said guide blades having a curved lifting surface.

3. A drive in accordance with claim 1, wherein the radial lengthwise extension (L) of the guide blades corresponds approximately to the radius (R) of the peak circular movement of the propellers.

4. A drive in accordance with claim 1 further comprising a nozzle mounted on said housing, part of the drive extending outside of the hull and being disposed within said nozzle.

* * * * *